United States Patent [19]

Deutsch

[11] 4,192,210

[45] Mar. 11, 1980

[54] FORMANT FILTER SYNTHESIZER FOR AN ELECTRONIC MUSICAL INSTRUMENT

[75] Inventor: Ralph Deutsch, Sherman Oaks, Calif.

[73] Assignee: Kawai Musical Instrument Mfg. Co. Ltd., Hamamatsu, Japan

[21] Appl. No.: 917,921

[22] Filed: Jun. 22, 1978

[51] Int. Cl.[2] ..... G10H 1/02

[52] U.S. Cl. ..... 84/1.01; 84/1.19; 84/1.21; 84/DIG. 9; 364/724

[58] Field of Search ..... 84/1.01, 1.03, 1.11, 84/1.12, 1.19, 1.2, 1.21, 1.24, DIG. 9; 364/718, 721, 724

[56] References Cited

U.S. PATENT DOCUMENTS

| | | | |
|---|---|---|---|
| 3,809,789 | 5/1974 | Deutsch | 84/1.19 |
| 3,956,960 | 5/1976 | Deutsch | 84/DIG. 9 |
| 4,000,675 | 1/1977 | Futamase | 84/1.01 |
| 4,026,179 | 5/1977 | Futamase | 84/1.01 |
| 4,085,644 | 4/1978 | Deutsch | 84/1.03 |

*Primary Examiner*—Gene Z. Rubinson
*Assistant Examiner*—William L. Feeney
*Attorney, Agent, or Firm*—Christie, Parker & Hale

[57] ABSTRACT

A fixed formant filter for a digital tone generator uses a set of scale factors generated by storing in memory a set of words corresponding to the relative amplitude of points on a single resonance curve. The words are addressed and read out of the memory in sequence in response to a counter. For each output state of the counter a group of words is read out of the memory, added, and stored as one scale factor of said set of scale factors. The number of words in the group read out corresponds to the number of resonant peaks in the fixed formant filter. The respective words in the group are addressed by modifying the output of the counter respectively by four constants corresponding to the relative position in the musical scale at which the resonant peaks of the formant filter occur.

6 Claims, 6 Drawing Figures

FORMANT FILTER SYNTHESIZER FOR AN ELECTRONIC MUSICAL INSTRUMENT

FIELD OF THE INVENTION

The present invention relates to digital musical tone generators, and more particularly, is concerned with apparatus for digitally synthesizing a fixed formant filter characteristic on the output of the tone generator.

BACKGROUND OF THE INVENTION

In copending application Ser. No. 917,920, filed June 22, 1978, entitled "Harmonic Formant Filter for an Electronic Musical Instrument", by the same inventor as the present application and assigned to the same assignee, and hereby incorporated by reference in the present application, there is described a system for implementing a fixed formant filter in a polyphonic tone synthesizer of the type described in U.S. Pat. No. 4,085,644. As described in the above-identified application, the attenuation versus frequency characteristic of the fixed formant filter is controlled by a set of scale factors stored in an addressable "read only" memory (ROM). While the number of words stored in the ROM is limited to 96 to implement one formant filter, it is desirable to store a number of such sets of words to permit the player of the instrument to select from a wide variety of formant filter characteristics. Assuming that each word in the memory is 6 bits in length and that it is desired to store data for up to 10 different formant filter characteristics, a ROM memorry having a capacity of 5760 bits would be required.

The present invention is directed to an arrangement for providing a wide selection of formant filter characteristics by synthesizing a set of scale factors as needed to produce a selected fixed formant filter. This permits the number of stored data bits to be greatly reduced and at the same time provides greater flexibility in choosing the formant filter response characteristic.

The concept of approximating formant filters having a low-pass, high-pass or Q-accent characteristic, is described for example, in U.S. Pat. Nos. 4,000,675 and 4,026,179. These patents disclose formant filters for use in tone synthesizers in which a series of straight line segments of attenuation v. frequency are used to approximate the desired response. The straight line segments are stored in the form of data consisting of the coordinants of the breaking points of the linear segments as well as the slopes of these segments. However, such known systems for synthesizing a formant filter requires large amounts of data to be stored for more complex filter characteristics.

SUMMARY OF THE INVENTION

The present invention is directed to an arrangement for synthesizing the data necessary to implement a fixed formant filter in a tone synthesizer which offers a very large economy in stored data and which is capable of generating fixed formants of a form which are known to be useful in the generation of sounds intended to simulate natural acoustical musical instruments and the human voice. The formant filter characteristics associated with these types of instruments and the human voice are characterized by having several independent resonances which occur at known frequencies and which have different peak values. According to the present invention, peak resonance values are stored as a function of frequency, which set of values is used for all "stops" used to select different filter characteristics. A set of note numbers is stored for each stop indicating the center frequencies at which the resonances occur for each stop. A standardized reference resonance curve is superimposed at each resonant frequency and is scaled by the peak value for that frequency to synthesize the desired formant curve.

DESCRIPTION OF THE DRAWINGS

For a more complete undestanding of the invention, reference should be made to the accompanying drawings, wherein.

DETAILED DESCRIPTION

The present invention is described as a modification to the fixed formant filter described in the above-identified copending application Ser. No. 917,920. The preferred embodiment of the present invention is illustrated for a system used to synthesize fixed formants corresponding to the human voice. However, this is only given by way of example since the invention is applicable to many other fixed formant filter characteristics for various types of acoustical musical instruments.

Figure 1:
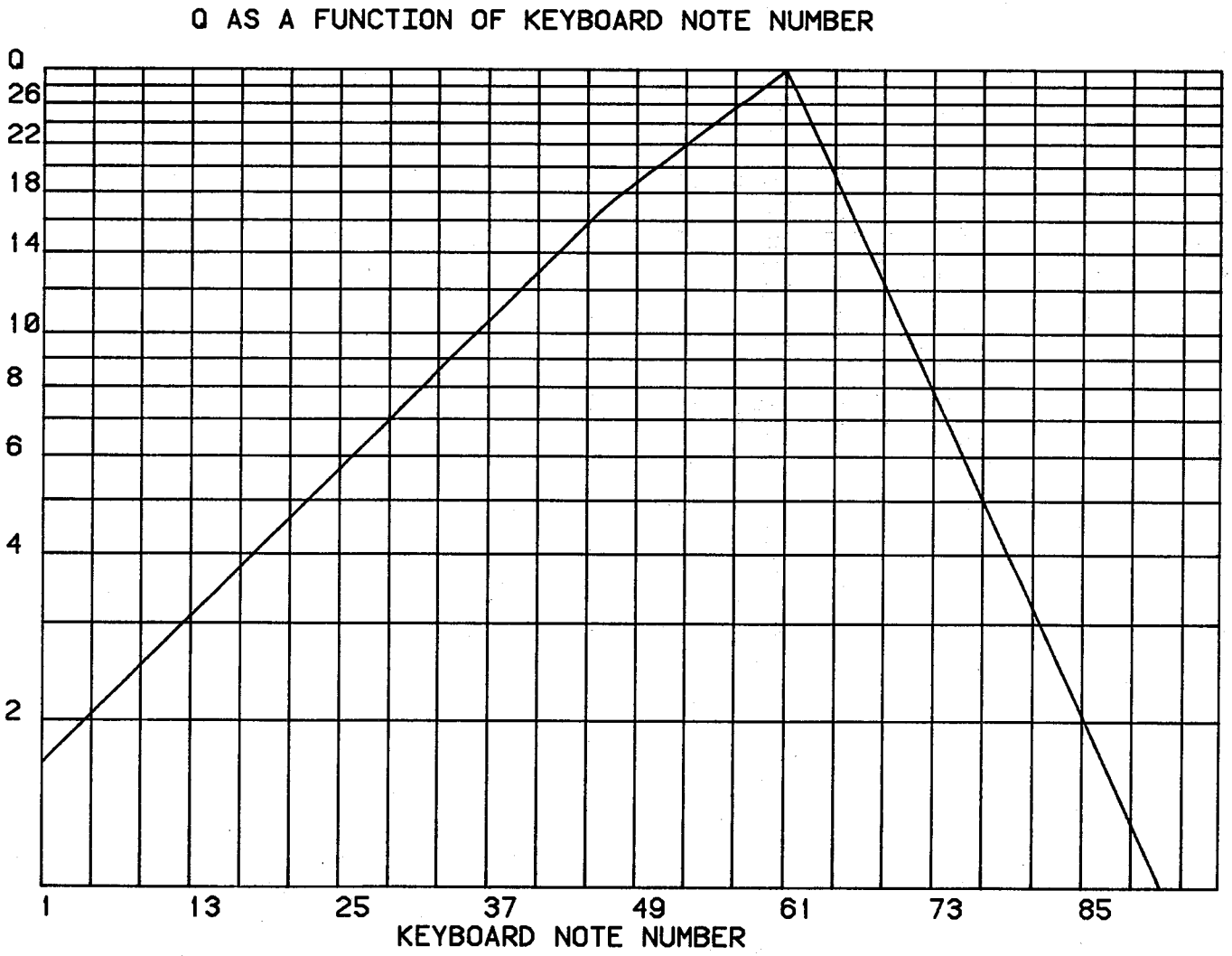
FIG. 1 is a graphical plot showing the change in the resonance characteristic Q as a function of frequency for the human voice.
Figure 2:
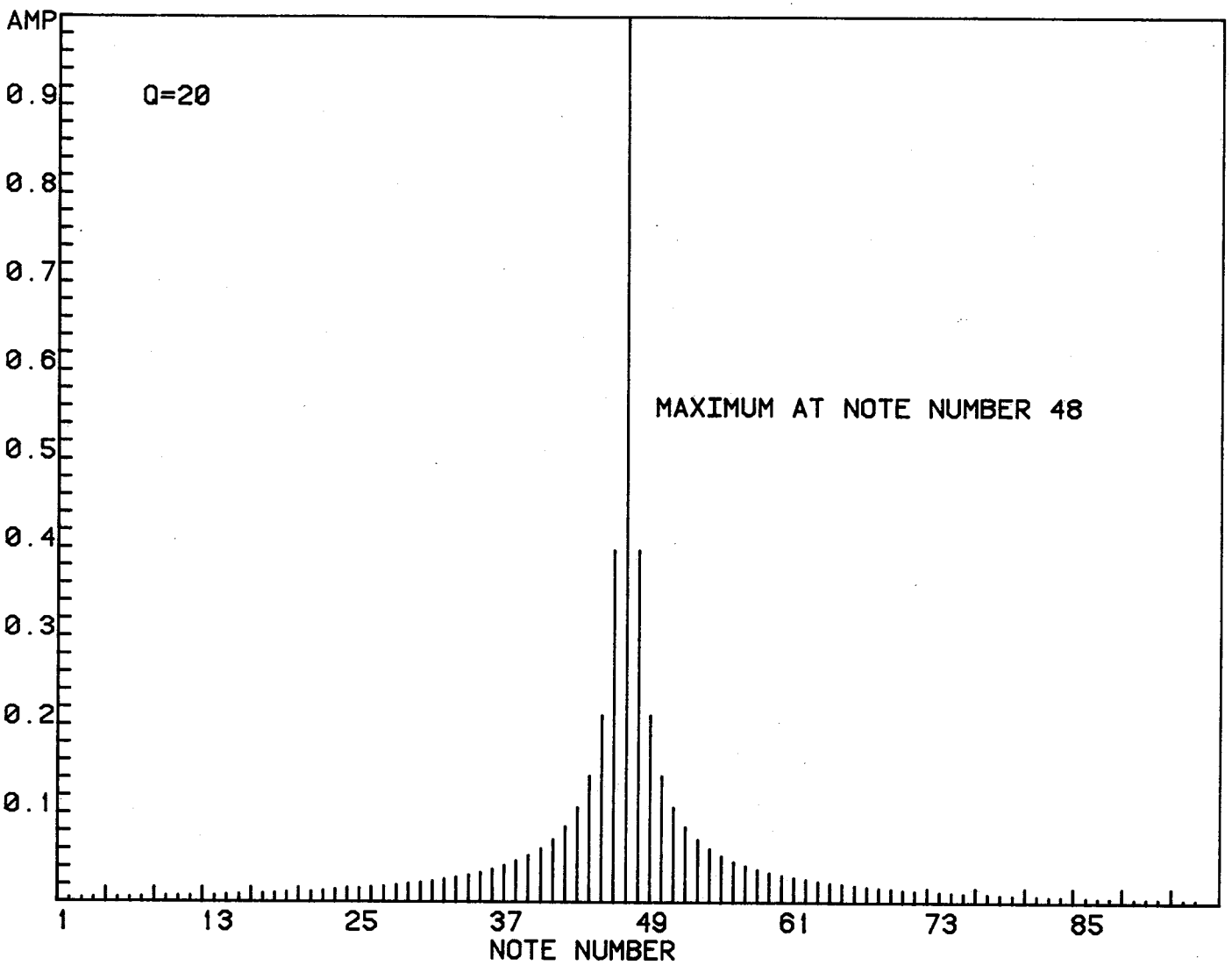
FIG. 2 is a plot of a standardized resonance curve.

As described in the above-identified application, it is convenient to express frequency in terms of note numbers N with the value N=1 corresponding to the note $C_2$ at 261.6 Hz. Studies have shown that typically the human voice is characterized by up to four resonances over the normal audio range. The frequencies at which these resonances occur varies with different voices, but are relatively independent of pitch of the voice. Moreover, studies have shown that the sharpness of the resonant peaks (the effective Q) varies with the resonant frequency in the manner shown in FIG. 1. In FIG. 1, frequency is represented in terms of note numbers and the value of Q varies as a log function. The values of Q as a function of note number are used according to the present invention to scale a group of resonant peaks whose center frequencies are selected by the player. A reference resonance curve is superimposed at each of the selected resonance frequencies. The reference resonance curve is preferably selected as one having a Q of 20, but this is given by way of example only. A reference resonance curve is shown in FIG. 2 which shows relative amplitude as a function of frequency expressed as note numbers, with the resonance peak corresponding to the note number of N=48. Data corresponding to the relative amplitudes of the reference curve of FIG. 2 is stored in an addressable memory. By selecting a group of resonant note numbers for each stop set by the player, a fixed formant filter can be synthesized having four resonant peaks with the Q of each peak varying as a function of note number according to the relationship shown in FIG. 1.

Figure 3:
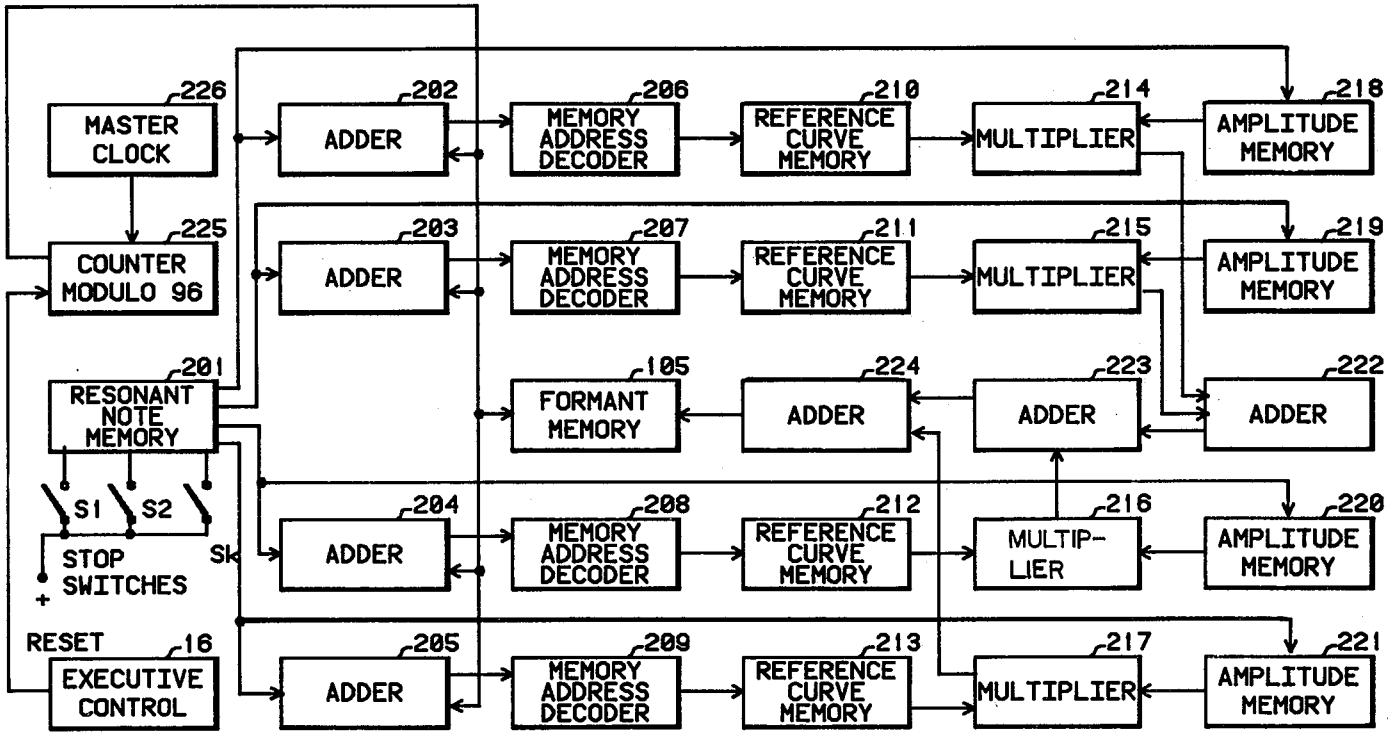
FIG. 3 is a schematic block diagram of one embodiment of the present invention.

Referring to FIG. 3 there is shown a system for implementing the fixed formant filter synthesizer and producing a formant filter characteristic having four resonant peaks. The arrangement of FIG. 3 is designed to compute a set of fixed formant scale factors which are loaded in a formant memory 105. The set of scale factors in the formant memory 105 operate to produce a fixed formant filter effect during the computation of the master data list in the manner described fully in the above-identified copending application.

According to the present invention, as shown in FIG. 3, sets of four resonant note numbers are stored in a resonant note memory 201 which is addressed to read out any selected set in response to the setting of one of a plurality of stop switches, such as indicated $S_l$ through $S_k$. These switches may be controlled in a variety of ways including being manually set by the player of the instrument. Depending upon which of the switches is closed, any selected one of a number of sets of four values is applied to a corresponding number of four output lines from the memory 201 which are applied as one input, respectively, to a group of four adders indicated at 202–205. Each output line from the resonant note memory 201 represents the note number corresponding to the resonance frequency of one of the four resonance peaks in the fixed formant filter characteristic to be synthesized. The other input to the adders 202–205 is derived from a counter 225 which is arranged to count up to 96 clock pulses from a master clock source 226. The counter 225 is reset by an executive control 16 at the start of a sub-computation cycle during which a table of formant filter scale factors is generated.

The output of each adder is used to address a respective one of a group of reference curve memories 210–213 by means of memory address decoders 206–209, respectively. The reference curve memories 210–213 each store the set of relative amplitude values for the respective note numbers corresponding to the resonance characteristic plotted in FIG. 2. The data in each of the reference curve memories 210–213 is therefore preferably identical. However, because the resonant note numbers from the memory 201 are different for each of the four resonances selected for the fixed formant filter characteristic being synthesized, the outputs from the respective reference curve memories will differ from each other for each setting of the counter 225.

In computing the addresses for the reference curve memories 210–213, it is more convenient, computationally, to store the contents of the resonant note memory 201 as the difference between the note number 48 representing the center point of the reference resonance curve and the note number $N_r$ representing the selected resonant point on the curve being synthesized. Thus by adding this difference value in the adder 202; for example, to the successive count conditions of the counter 225, the addresses for addressing the reference curve data in the reference curve memory 210 modified so as to effectively shift the center frequency of the resonance in the curve being synthesized. For example, if it is desired to have a resonance peak at note number 20, the difference number 28 is stored in the resonant note memory 201. When the counter 225 counts to the note number 20 corresponding to the desired resonance point in the curve being synthesized, the output of the adder 202 is 48 (20+28), which corresponds to the note number of the peak resonance point of the reference curve stored in memory 210. Of course as the counter 225 counts through values below and above 20, the corresponding points on either side of the resonant point in the reference curve of memory 210 are respectively addressed and read out of the reference curve memory. Thus, the output values read out of the reference curve memory with the counting of the counter 225 correspond to the points along the curve of the resonance reference curve of FIG. 2 shifted to note number 20 as the frequency position of the resonance peak. The output from each of the other reference curve memories 211, 212, and 213 similarly will correspond to the resonance curve but with the resonance peak frequency shifted according to the respective values read out of the resonant note memory 201.

The resonance curve values read out of the respective memories with each count condition of the counter 225 are scaled by a predetermined scale factor derived from corresponding amplitude memories 218–221 by means of multipliers 214–217. These respective memories are addressed in response to the four outputs from the resonant note memory 201. The information stored in the four amplitude memories is preferably identical and corresponds to the relative values of Q as a function of note number, as set forth in the curve of FIG. 1. However, other relationships of Q as a function of frequency may be used and stored in the amplitude memories.

Figure 4:
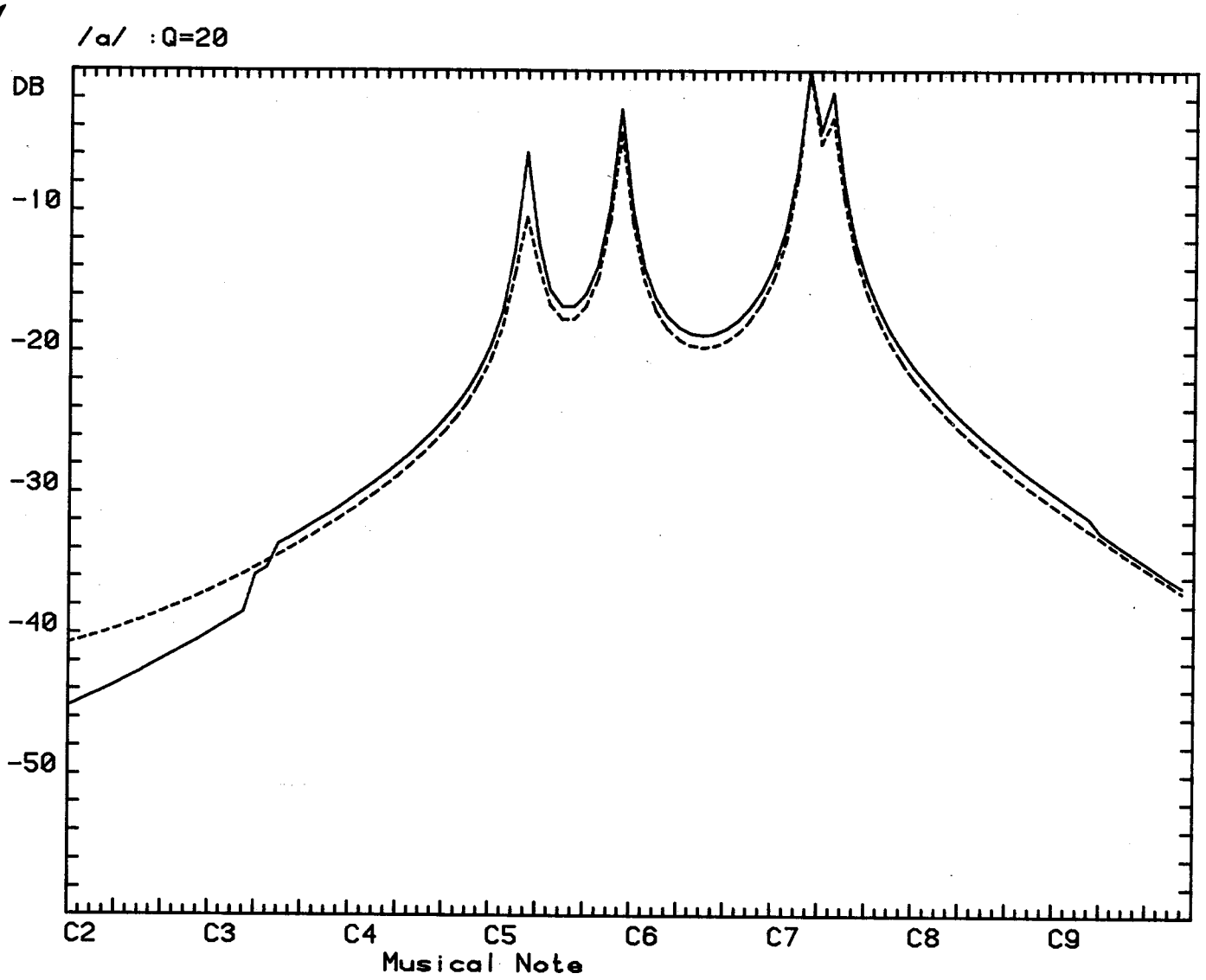
FIG. 4 is a graphical plot of a formant filter transfer characteristic.

The outputs from the four multipliers 214–217 are combined by adders 222–224 and the sum stored as one value in the formant memory 105. The formant memory 105 is addressed by the counter 225. Thus, for each step of the counter 225 by the master clock 226, a value corresponding to a point on the formant characteristic curve is stored in the formant memory 105. A typical curve corresponding to one such set of values is shown in FIG. 4. For each stop switch used to select a difference set of four values from the resonant note memories, a different set of values is stored in the formant memory 105 by the sequencing of counter 225. Once the formant memory 105 is loaded with the one set of computed values, the contents of the formant memory 105 are utilized to produce a fixed formant filter effect in the polyphonic tone synthesizer in the manner described in detail in the above-identifed copending application. FIG. 4 shows a formant filter curve obtained from the system shown in FIG. 3. The solid line represents the curve corresponding to the data loaded in the formant memory 105, whereas the dash line is a theoretical response for the same four resonant frequencies.

In the arrangement shown in FIG. 3, four separate channels are disclosed for calculating the curve for each of the four resonances, the resulting data being the sum of the four resonance curves. Since the contents of the reference curve memories in the amplitude memories for the four channels are preferably identical, it will be apparent that the four channels can be combined into a single channel which is time-shared by the four resonant frequencies. This requires that the formant filter computation cycle be divided timewise into four segments with one of the resonance curves being computed and stored in the formant memory 105 during each time segment. Thus in the arrangement of FIG. 5, the executive control 16 by means of a data select circuit 229 selects one of the four outputs at a time from the resonant note memory 201 as one input to a single computation channel including adder 202, memory address decoder 206, reference curve memory 210, multiplier 214, and amplitude memory 218. The data for one complete resonance curve is computed by advancing the counter 225 through a full count and accumulating the results in an adder-accumulator 227. This process is repeated for the next resonance curve by means of the data select circuit 229 and the results added to the previously generated data by adder-accumulator 227. After all four resonances have been computed, the contents of the adder-accumulator 227 are transferred to the formant memory 105 to provide one set of formant filter scale factors.

Figure 5:
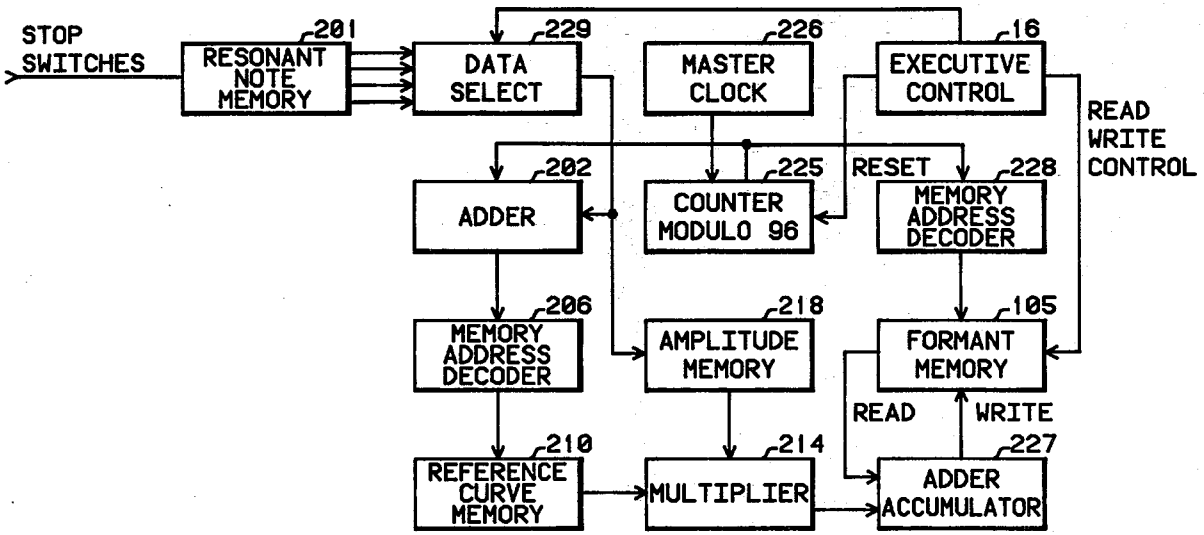
FIG. 5 is a schematic block diagram of an alternative embodiment of the present invention.
Figure 6:
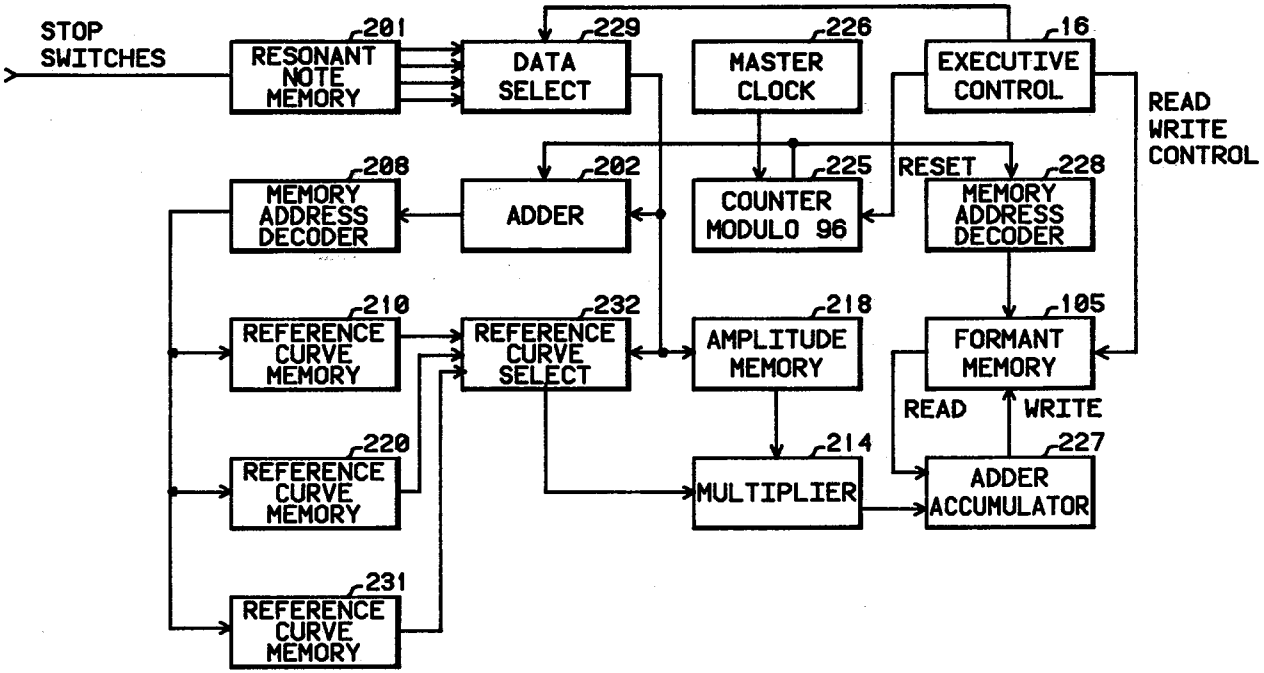
FIG. 6 is a schematic block diagram of a further modification of the present invention.

The arrangement in FIG. 6 is similar to that in FIG. 5 but illustrates that more than one resonance reference curve may be utilized. Thus in the arrangement of FIG. 6, three separate reference resonance curves are stored in each of three reference curve memories 210, 220, and 231. A reference curve select circuit 232 allows the output of any one of the three reference curve memories to be applied as one input to the multiplier 214. The select circuits respond to the range of the values of the output from the resonant note memory 201. Thus a different resonance curve can be selected depending on the relative frequency (note number) of each resonant point.

From the above description it will be seen that apparatus is provided for the synthesis of formant filters from a combination of stored reference curves. The amplitude memory provides a means of introducing the effect of variable Q. While the number of resonances is shown by way of example as being four in number, it will be appreciated that the system can be modified to provide any desired number of resonance points in the filter characteristic. While a standard resonance curve has been described as used in the preferred embodiment, the curve data stored in the reference curve memory may correspond to any desired curve shape, such as a band pass filter characteristic.

What is claimed is:

1. In a tone generator in which the relative amplitudes of a succession of points defining the waveform of an audio signal are generated digitally by adding the amplitudes for each of said points of a number of Fourier harmonic components of the waveform, the relative amplitudes of the points for each component being determined by multiplying a set of orthogonal function values by a harmonic coefficient value, and in which the relative amplitude values for each harmonic are scaled by a different scale factor from a stored list of scale factors corresponding to a fixed formant filter characteristic, apparatus for generating said list of scale factors comprising: an addressable memory means storing a group of words corresponding to the relative amplitudes of points defining a resonance curve, addressing means including a counter and a source of data designating a group of notes corresponding in frequency to the center frequencies of resonant peaks of the fixed formant filter for addressing said addressable memory means, said addressing means including means for modifying the counter output by an amount determined by each of the group of notes from said source of data to generate a corresponding group of addresses for addressing said memory with each setting of the counter, means for adding the resulting group of words read out from said addressable memory means for each setting of the counter, and means storing the sum of each of said group of words to form said scale factor list, whereby said last-named storing means stores a set of words corresponding in number to the modulo of the counter, the value of the words corresponding to the relative amplitudes of points defining the composite of a group of resonance curves.

2. Apparatus of claim 1 further including means for separately scaling the words from said addressable storage means by a predetermined scale factor, and means responsive to said source of data for selecting a different scale factor for each of said resonant curves, whereby the peak amplitude of each of the resonant curves is separately scaled.

3. Apparatus of claim 1 further including means selectively changing the notes corresponding to the center frequencies of the resonant peaks, whereby the frequencies of the resonant peaks may be selectively shifted.

4. Apparatus of claim 2 further including means selectively changing the notes corresponding to the center frequencies of the resonant peaks.

5. Apparatus of claim 1 wherein the addressable memory means stores additional groups of words, each group of words corresponding to the relative amplitudes at frequencies corresponding to the notes of the musical scale, the words defining the relative amplitude of points along a resonance curve, and means for selecting one of said groups in the addressable memory means to be addressed by said addressing means.

6. Apparatus for synthesizing the amplitude versus frequency characteristic of any selected one of a plurality of fixed formant filters in the generation of musical tones created digitally by computing a master data set of words digitally representing the relative amplitudes of points on the waveform of the tone to be generated, the master data list being formed by separately generating a set of words digitally representing the relative amplitudes of said points for each of said Fourier components of the waveform to be generated and adding the words of corresponding points in each of the component sets to form the master data set, said apparatus comprising: means selectively generating a group of words identifying respectively notes on the musical scale corresponding to the center frequencies of a predetermined number of resonant peaks in the filter characteristic, addressable memory means storing a set of words corresponding to the relative amplitudes of points along a fixed curve having a standard filter characteristic, the points corresponding in frequency to successive notes on the musical scale, means generating a sequence of addresses, means modifying each of said address by amounts corresponding to the difference between the address of the word representing the peak amplitude value of the stored set of resonance curve defining words and each of the selectively generated group of words, means addressing and reading out words from the addressable memory means by the output of the means modifying each of said addresses, whereby a group of words corresponding to said predetermined number is read out of the addressable memory means in response to each address in said generated sequence of addresses, means adding the group of words read out of the addressable memory means in response to each of the sequence of addresses, and means storing the output of the adding means to form a stored set of scale factors for the formant filter.

* * * * *